US011245203B2

(12) United States Patent
Semonov et al.

(10) Patent No.: US 11,245,203 B2
(45) Date of Patent: Feb. 8, 2022

(54) ANTENNA MODULE, SYSTEM, AND METHOD

(71) Applicant: Amphenol Antenna Solutions, Inc., Rockford, IL (US)

(72) Inventors: Kostyantyn Semonov, Denver, NC (US); Ryan Michael Nagel, Tucson, AZ (US); André Falconio Armand Fournier, Marietta, GA (US)

(73) Assignee: AMPHENOL ANTENNA SOLUTIONS, INC., Rockford, IL (US)

( * ) Notice: Subject to any disclaimer, the term of this patent is extended or adjusted under 35 U.S.C. 154(b) by 0 days.

(21) Appl. No.: 16/778,671

(22) Filed: Jan. 31, 2020

(65) Prior Publication Data

US 2021/0242608 A1 Aug. 5, 2021

(51) Int. Cl.

| | |
|---|---|
| ***H01Q 21/28*** | (2006.01) |
| ***H01Q 1/24*** | (2006.01) |
| ***H01Q 19/00*** | (2006.01) |
| ***H01Q 21/12*** | (2006.01) |
| ***H01Q 1/42*** | (2006.01) |
| ***H01Q 1/36*** | (2006.01) |

(52) U.S. Cl.

CPC ..... *H01Q 21/28* (2013.01); *H01Q 1/24* (2013.01); *H01Q 1/36* (2013.01); *H01Q 1/42* (2013.01); *H01Q 19/005* (2013.01); *H01Q 21/12* (2013.01)

(58) Field of Classification Search

CPC ..... H01Q 21/26; H01Q 21/28; H01Q 21/12; H01Q 19/005

See application file for complete search history.

(56) References Cited

U.S. PATENT DOCUMENTS

| | | | |
|---|---|---|---|
| 10,424,830 | B2 | 9/2019 | Semonov et al. |
| 2014/0028516 | A1 | 1/2014 | Semonov et al. |
| 2018/0115067 | A1 | 4/2018 | Chen et al. |

FOREIGN PATENT DOCUMENTS

WO WO-2012102576 A2 * 8/2012 ..... H01Q 21/08

OTHER PUBLICATIONS

He et al., A novel broadband dual-polarized dipole antenna element for 2G/3G/LTE base stations, IEEE International Conference on RFID Technology and Applications, 2016, Abstract.

Cui et al., A Novel Broadband Planar Antenna for 2G/3G/LTE Base Stations, IEEE Transactions on Antennas and Propagation, May 5, 2013, pp. 2767-2774, vol. 61, No. 5.

He et al., A Novel Dual-Broadband and Dual-Polarized Antenna for 2G/3G/LTE Base Stations, IEEE Transactions on Antennas and Propagation, Sep. 9, 2016, pp. 4113-4118, vol. 64, No. 9.

* cited by examiner

*Primary Examiner* — Hoang V Nguyen

(74) *Attorney, Agent, or Firm* — Kunzler Bean & Adamson

(57) ABSTRACT

One antenna module includes a first circuit board and a second circuit board connected to the first circuit board. The antenna module includes a first antenna disposed on the first circuit board. The antenna module also includes a second antenna disposed on the second circuit board. The second circuit board has a first side and a second side opposite the first side. The second antenna includes a first parasitic strip and a second parasitic strip. The first parasitic strip is disposed on the first side of the second circuit board, and the second parasitic strip is disposed on the second side of the second circuit board.

21 Claims, 8 Drawing Sheets

ANTENNA MODULE, SYSTEM, AND METHOD

FIELD

This disclosure relates generally to antenna modules, and more particularly to antenna modules having multiple antennas.

BACKGROUND

Antenna modules may be manufactured to produce antennas having different frequencies. Such antenna modules may be limited in frequency range. Certain antenna modules may include multiple antennas.

SUMMARY

The subject matter of the present application provides examples of an antenna module, system, and method that overcome at least some of the shortcomings of prior art techniques. Accordingly, the subject matter of the present application has been developed in response to the present state of the art, and in particular, in response to shortcomings of conventional antenna modules.

An aspect of this disclosure is an antenna module that includes a first circuit board. The antenna module also includes a second circuit board connected to the first circuit board. The antenna module includes a first antenna disposed on the first circuit board. The antenna module also includes a second antenna disposed on the second circuit board. The second circuit board has a first side and a second side opposite the first side. The second antenna includes a first parasitic strip and a second parasitic strip. The first parasitic strip is disposed on the first side of the second circuit board, and the second parasitic strip is disposed on the second side of the second circuit board.

In certain embodiments, a first end of the first parasitic strip is horizontally misaligned with a second end of the second parasitic strip.

In some embodiments, misalignment between the first end and the second end results in a resonance corresponding to the second antenna during operation of the second antenna.

In other embodiments, the first antenna is physically separated from the second antenna by a gap.

In certain embodiments, the first circuit board has a first thickness, the second circuit board has a second thickness, and the first thickness is less than the second thickness.

In some embodiments, the antenna module includes multiple mechanical couplers that connect the first circuit board to the second circuit board.

In other embodiments, the first parasitic strip and the second parasitic strip extend parallel to a horizontal bar portion of an L-shaped portion of the first antenna.

In certain embodiments, the first antenna transmits at a first frequency and the second antenna transmits at a second frequency different from the first frequency.

In some embodiments, the first antenna is electrical connected to the second antenna.

In other embodiments, the antenna module includes a third circuit board coupled to the first circuit board such that the third circuit board is perpendicular to the first circuit board, and the third circuit board includes a third antenna.

In certain embodiments, the antenna module includes a fourth circuit board coupled to the second circuit board such that the fourth circuit board is perpendicular to the second circuit board, and the fourth circuit board includes a fourth antenna.

In some embodiments, the antenna module includes a first electrical connection that electrically connects the first antenna to the second antenna.

In other embodiments, the antenna module includes a second electrical connection that electrically connects the third antenna to the fourth antenna.

In certain embodiments, the antenna module includes a first port electrically coupled to the first electrical connection, and a second port electrically coupled to the second electrical connection, wherein the first port is configured to operate the first and second antennas, and the second port is configured to operate the third and fourth antennas.

Another aspect of this disclosure is a system that includes a first circuit board, a second circuit board coupled to the first circuit board such that the second circuit board is perpendicular to the first circuit board, a third circuit board coupled to the first circuit board such that the third circuit board is co-planar with the first circuit board, a fourth circuit board coupled to the third circuit board such that the fourth circuit board is perpendicular to the third circuit board and coupled to the second circuit board such that the fourth circuit board is co-planar with the third circuit board, a first antenna disposed on the first circuit board, and a second antenna disposed on the second circuit board. The first antenna and the second antenna each have an inverted L-shaped portion, a third antenna is disposed on the third circuit board, and a fourth antenna is disposed on the fourth circuit board. Each of the third antenna and the fourth antenna include a first parasitic strip and a second parasitic strip opposite the first parasitic strip.

In certain embodiments, the first parasitic strip is horizontally offset relative to the second parasitic strip such that a first end of the first parasitic strip extends past a second end of the second parasitic strip.

In some embodiments, the first antenna is physically separated from the third antenna by a first gap having a first predetermined distance, and the second antenna is physically separated from the fourth antenna by a second gap having a second predetermined distance.

In other embodiments, the first circuit board has a first thickness, the third circuit board has a second thickness, and the first thickness is less than the second thickness.

In certain embodiments, the system includes multiple couplers that vertically connect the first and second circuit boards to the third and fourth circuit boards. Each coupler of the multiple couplers includes a slot within which a corresponding one of the third and fourth circuit boards and a corresponding one of the first and second circuit boards is fixed.

Yet another aspect of this disclosure is a method including vertically aligning a first substrate with a second substrate. The first substrate has a first thickness and includes a first antenna, the second substrate has a second thickness greater than the first thickness and includes a second antenna, the second antenna includes a first parasitic strip and a second parasitic strip, the first parasitic strip is disposed on a first side of the second substrate, and the second parasitic strip is disposed on a second side of the second substrate opposite the first side of the second substrate. The method includes electrically coupling the first antenna to the second antenna, and clamping the first substrate to the second substrate.

In another aspect of this disclosure is an antenna module including a first antenna disposed on a first substrate. The antenna module also includes a second antenna disposed on a second substrate. The second substrate has a first side and a second side opposite the first side. The second antenna includes a first parasitic strip and a second parasitic strip. The first parasitic strip is disposed on the first side of the second substrate, and the second parasitic strip is disposed on the second side of the second substrate. A return loss corresponding to the antenna module is between −10 dB and −25 dB, and a polarization port isolation corresponding to the antenna module is less than −25 dB.

It is to be understood that both the foregoing general description and the following detailed description are exemplary and are intended to provide an overview or framework to understand the nature and character of the disclosure. The various embodiments described above and in the following detailed description may be used individually or in combination with other embodiments. Those skilled in the art will appreciate various combinations of embodiments not specifically described herein that are still within the scope of this disclosure. In this respect, it is to be understood that the disclosure is not limited in its application to the specific embodiments set forth in the written description or illustrated in the drawings.

BRIEF DESCRIPTION OF THE DRAWINGS

The accompanying drawings are incorporated in and constitute a part of this specification. It is to be understood that the drawings illustrate only some embodiments of the disclosure and other embodiments or combinations of various embodiments that are not specifically illustrated in the figures may still fall within the scope of this disclosure. For example, as will be understood by those of ordinary skill in the art, features and attributes associated with embodiments shown in one of the figures may be applied to embodiments shown in other figures.

Unless otherwise indicated, the drawings are not to scale and certain drawings, or aspects of a drawing, may be illustrated symbolically or schematically.

Figure 1:
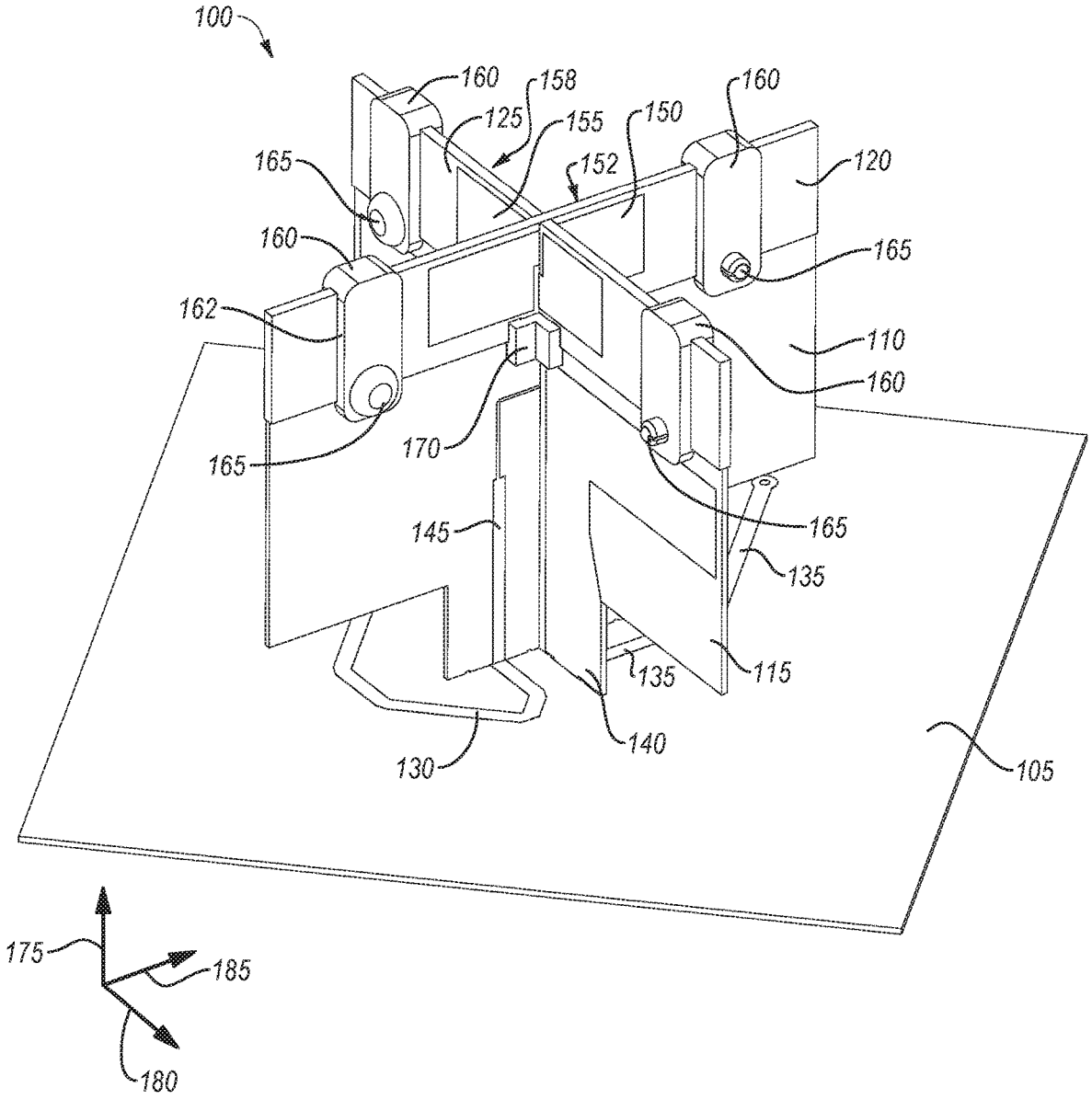
Figure 2:
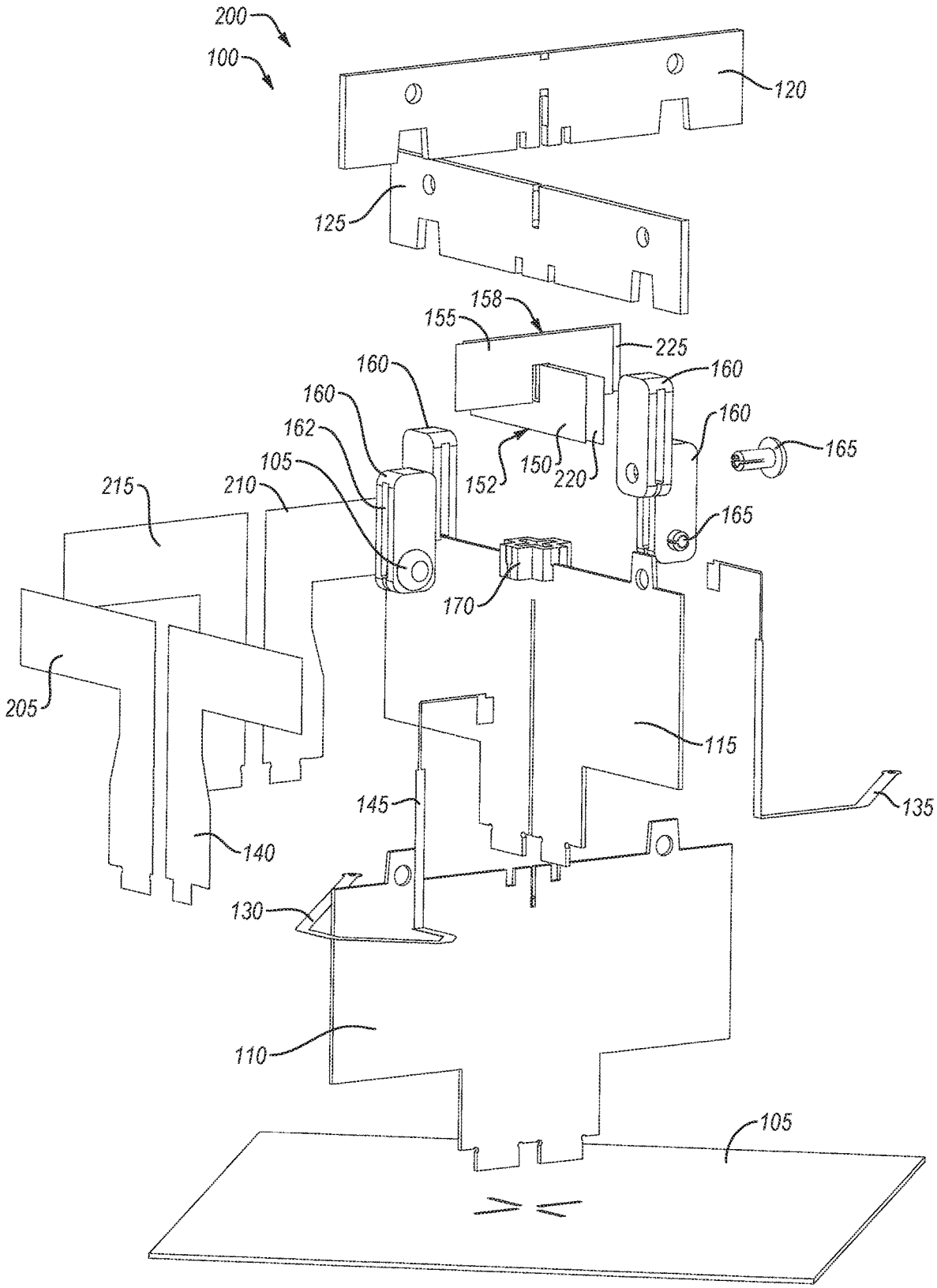
Figure 3:
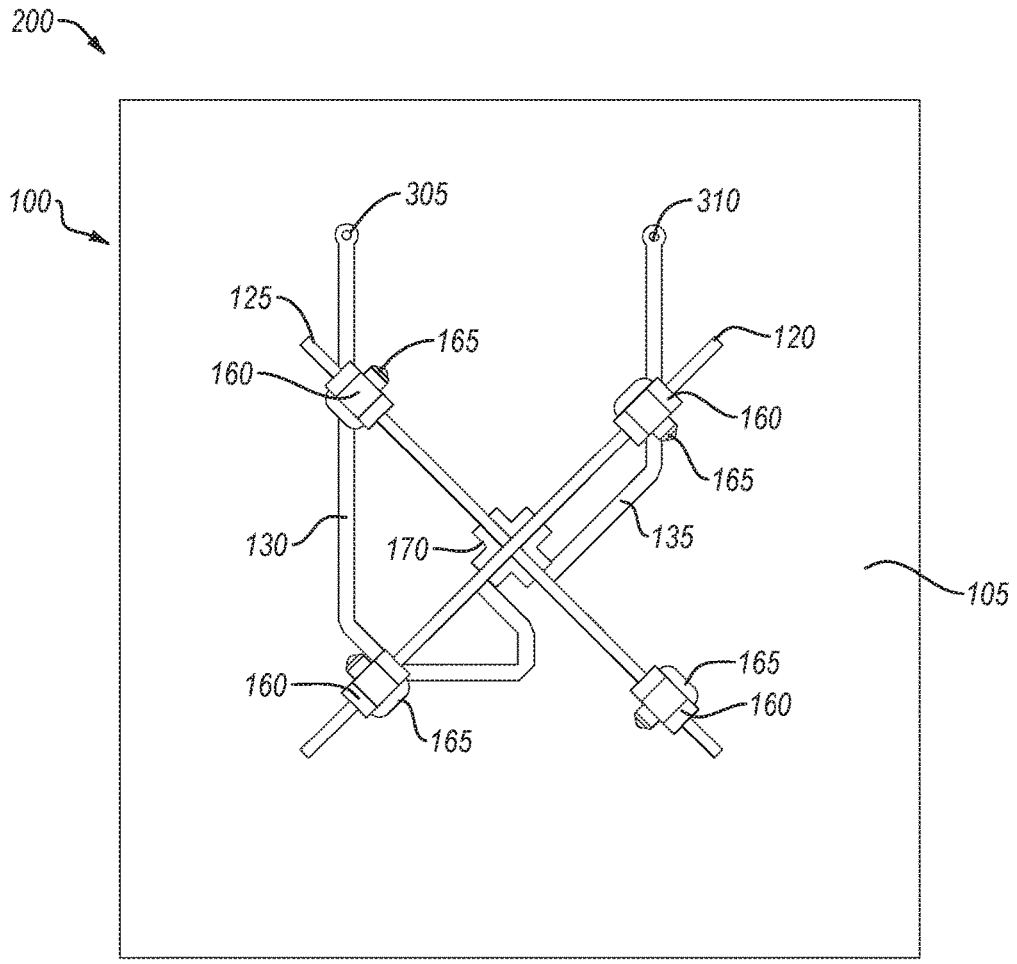
Figure 4:
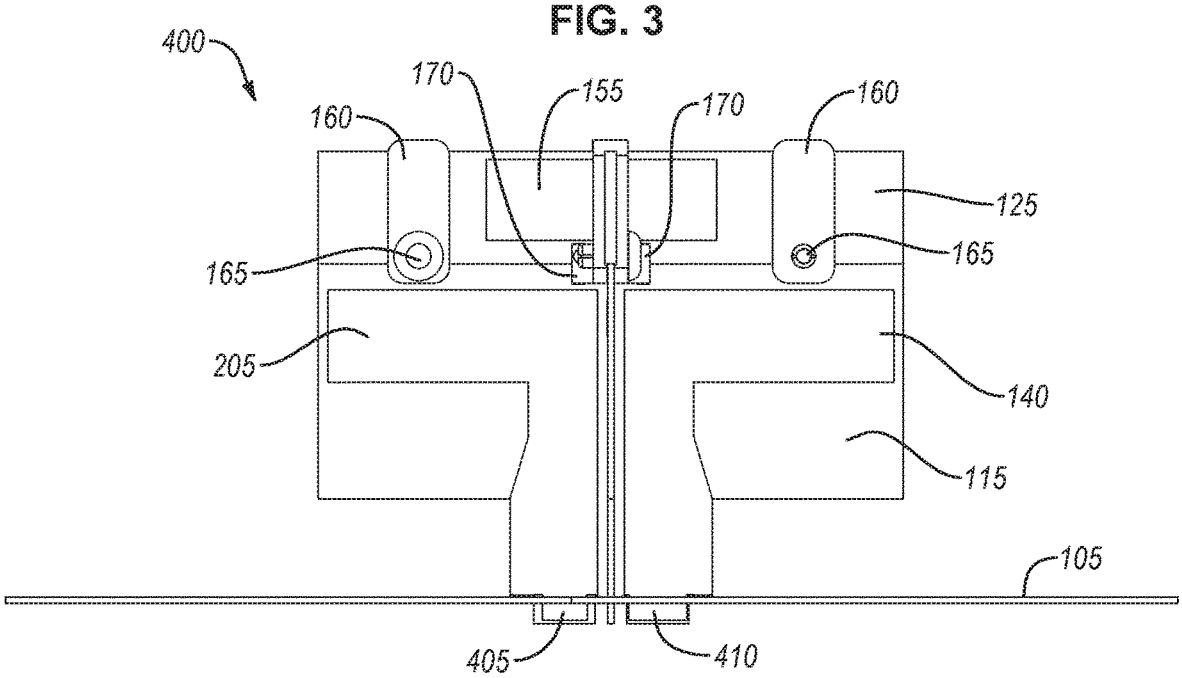
Figure 5:
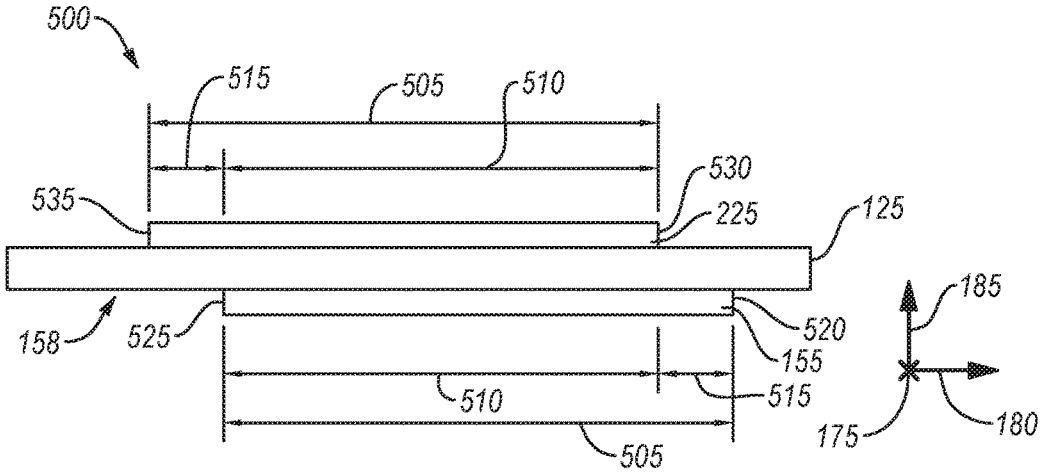
Figure 6:
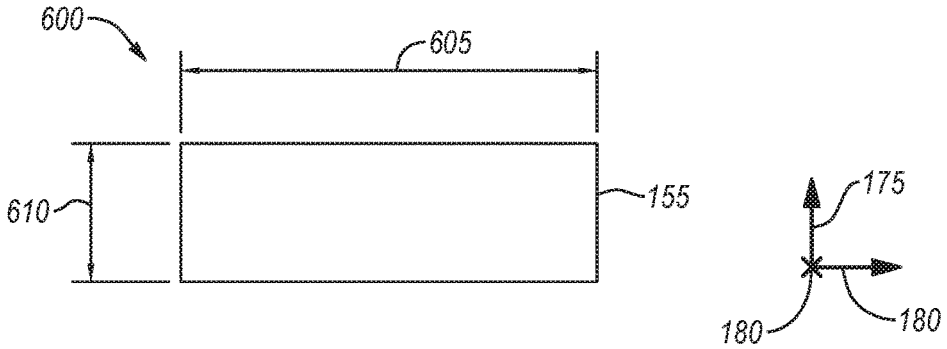
Figure 7:
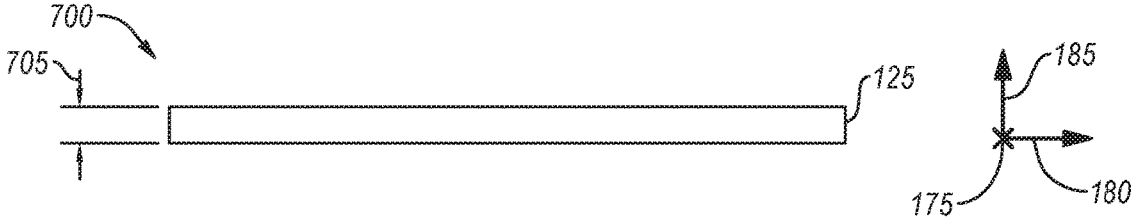
Figure 8:
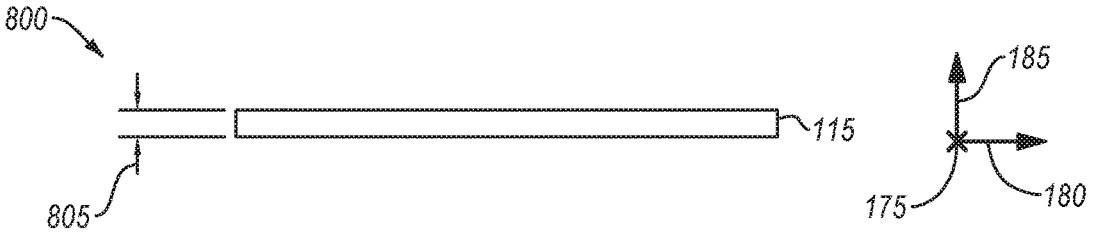
Figure 9:
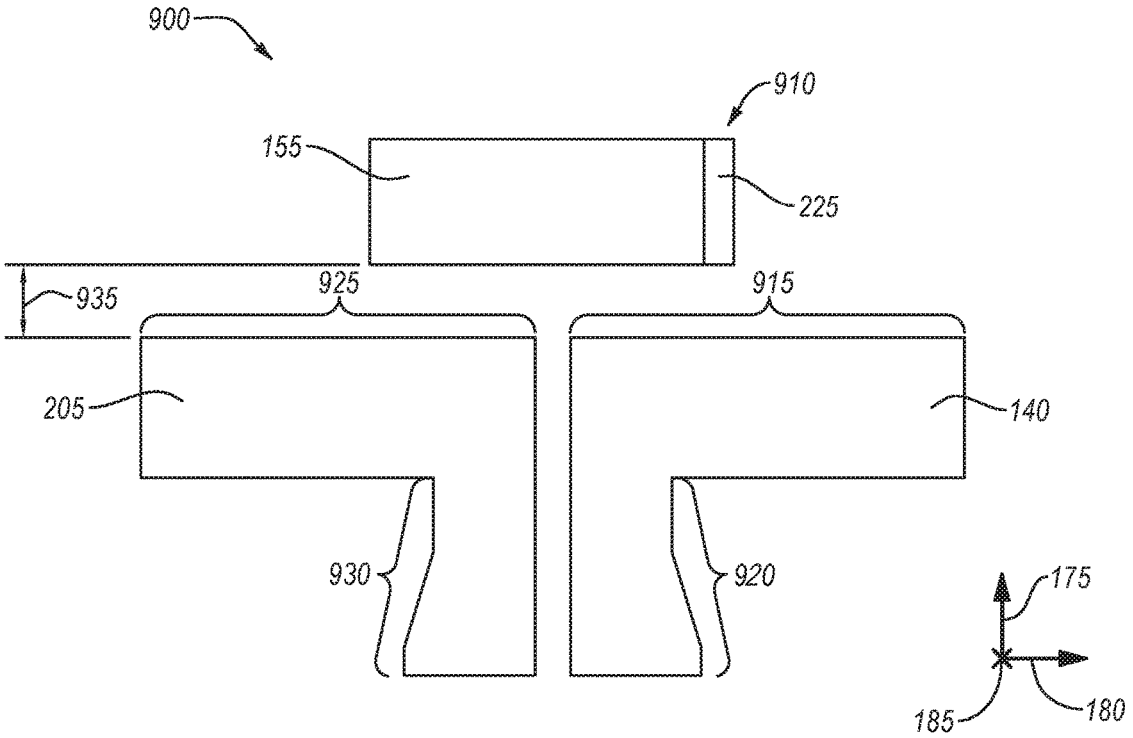
Figure 10:
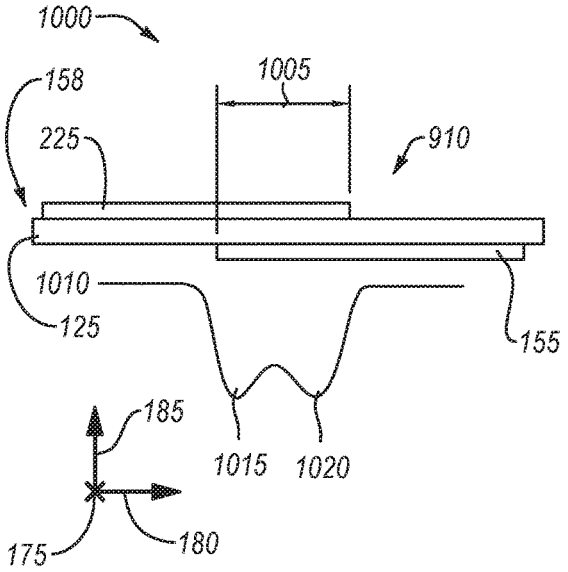
Figure 11:
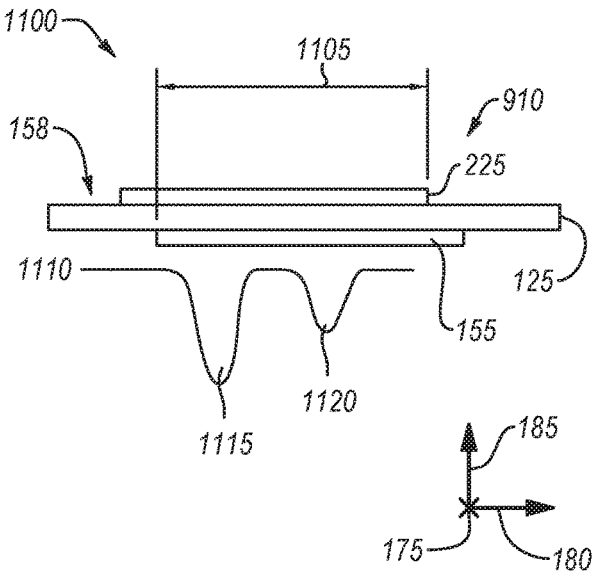
Figure 12:
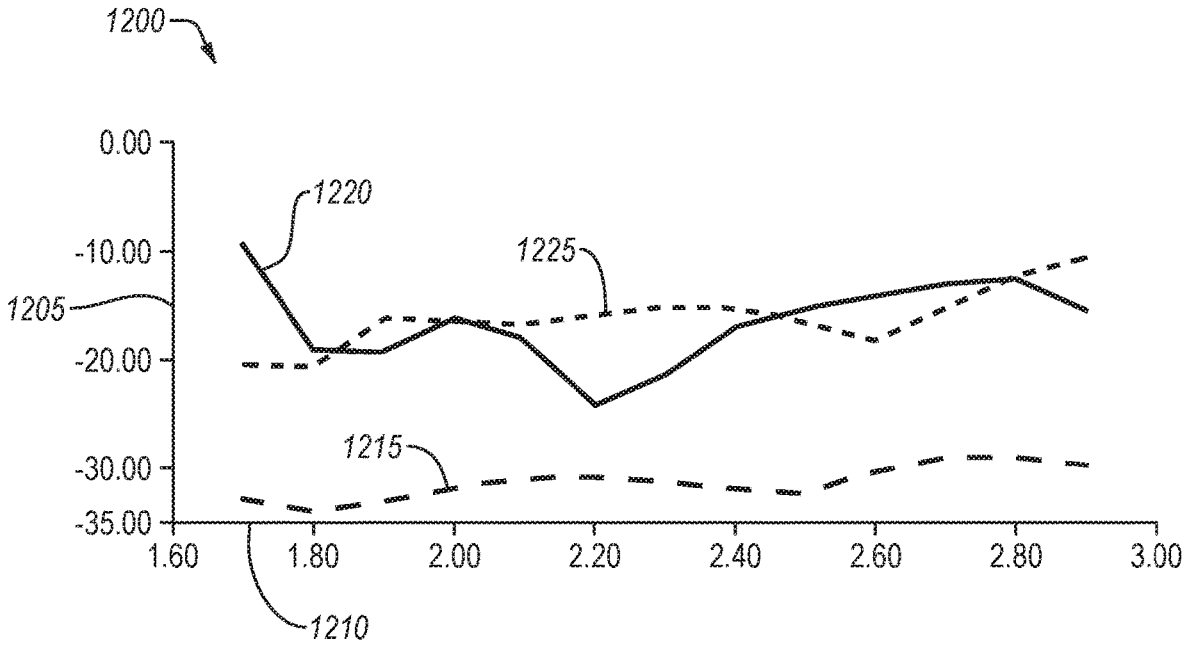
Figure 13:
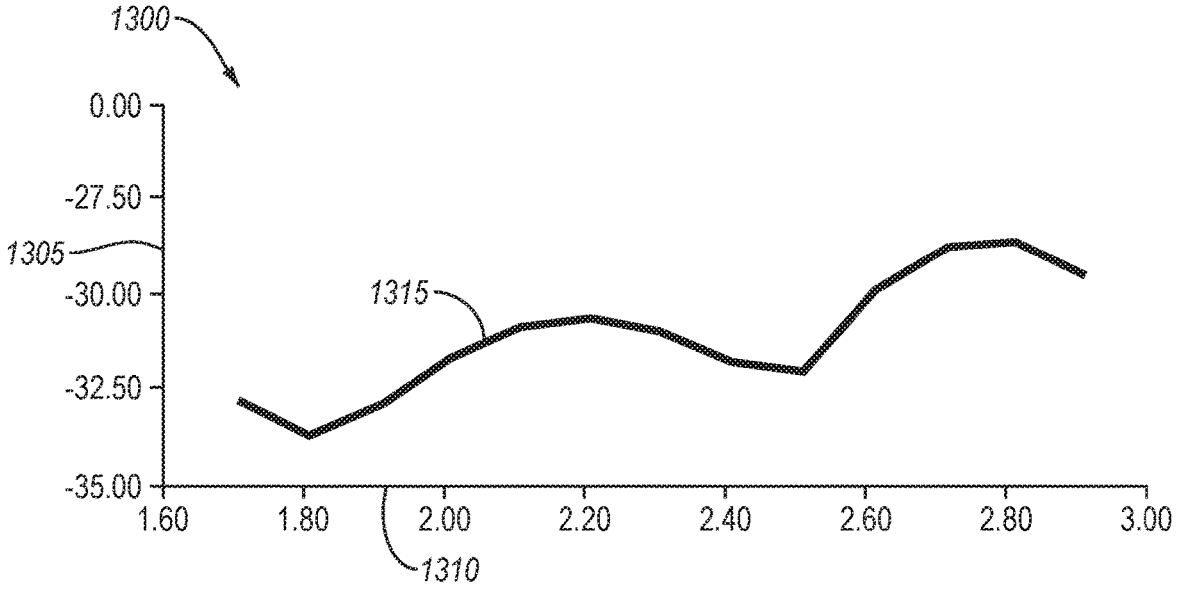
Figure 14:
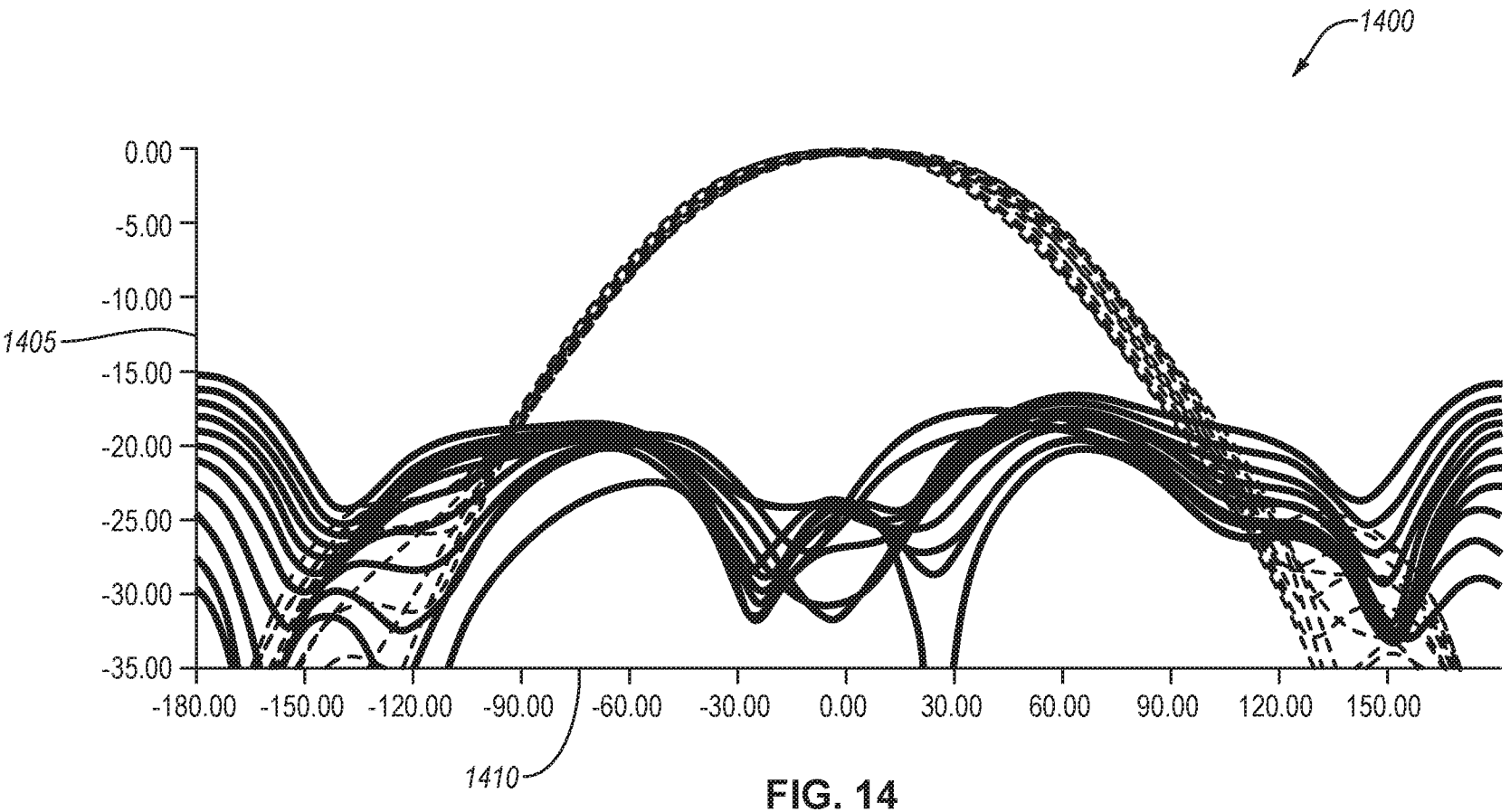
Figure 15:
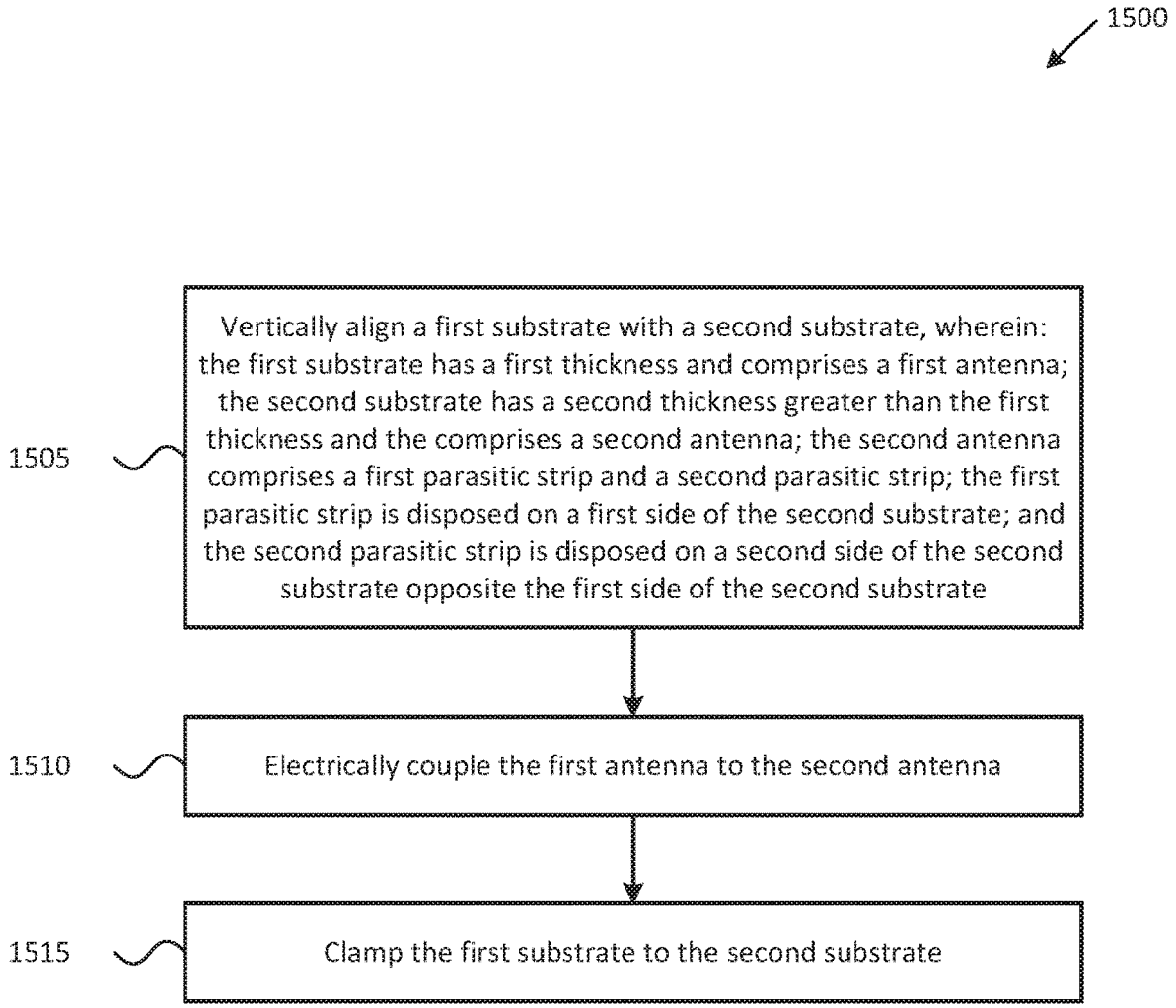

Embodiments of the disclosure will now be described with additional detail through the use of the drawings, in which:

FIG. 1 is a side perspective view of an exemplary antenna module, according to one embodiment;

FIG. 2 is an exploded view of the antenna module of FIG. 1;

FIG. 3 is a top view of the antenna module of FIG. 1;

FIG. 4 is a side view of the antenna module of FIG. 1;

FIG. 5 is a top view of parasitic strips of FIG. 1, according to one embodiment;

FIG. 6 is a side view of the parasitic strip of FIG. 1;

FIG. 7 is a top view of the fourth circuit board of FIG. 1;

FIG. 8 is a top view of the second circuit board of FIG. 1;

FIG. 9 is a side view of antennas of FIG. 1;

FIG. 10 is a top view of parasitic strips of FIG. 1 and a corresponding frequency graph, according to another embodiment;

FIG. 11 is a top view of parasitic strips of FIG. 1 and a corresponding frequency graph, according to yet another embodiment;

FIG. 12 is an illustration showing return loss and isolation for the antenna module of FIG. 1;

FIG. 13 is an illustration showing isolation for the antenna module of FIG. 1;

FIG. 14 is an illustration showing frequency patterns for the antenna module of FIG. 1; and FIG. 15 is a schematic illustrating of a method for manufacturing the antenna module of FIG. 1.

DETAILED DESCRIPTION

Reference will now be made in detail to certain embodiments, examples of which are illustrated in the accompanying drawings. Although certain embodiments will be described in detail, it should be understood that various changes and modifications may be made without departing from the scope of the disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiment of the present disclosure, however, absent an express correlation to indicate otherwise, an implementation may be associated with one or more examples.

Embodiments disclosed include an antenna module. In certain embodiments, the antenna module includes a first circuit board. In another embodiment, the antenna module includes a second circuit board connected to the first circuit board. In some embodiments, the antenna module includes a first antenna disposed on the first circuit board. In various embodiments, the antenna module includes a second antenna disposed on the second circuit board. In certain embodiments, the second circuit board has a first side and a second side opposite the first side. In another embodiment, the second antenna includes a first parasitic strip and a second parasitic strip. In some embodiments, the first parasitic strip is disposed on the first side of the second circuit board, and the second parasitic strip is disposed on the second side of the second circuit board.

Embodiments disclosed also include a system. In certain embodiments, the system includes a first circuit board. In some embodiments, the system includes a second circuit board coupled to the first circuit board such that the second circuit board is perpendicular to the first circuit board. In various embodiments, the system includes a third circuit board coupled to the first circuit board such that the third circuit board is co-planar with the first circuit board. In another embodiment, the system includes a fourth circuit board coupled to the third circuit board such that the fourth circuit board is perpendicular to the third circuit board and coupled to the second circuit board such that the fourth circuit board is co-planar with the third circuit board. In certain embodiments, a first antenna is disposed on the first circuit board, and a second antenna is disposed on the second circuit board. In some embodiments, the first antenna and the second antenna each have an inverted L-shaped portion. In various embodiments, a third antenna is disposed on the third circuit board, and a fourth antenna is disposed on the fourth circuit board. In another embodiment, each of the third antenna and the fourth antenna include a first parasitic strip and a second parasitic strip opposite the first parasitic strip.

Embodiments disclosed include a method. In one embodiment, the method includes vertically aligning a first substrate with a second substrate. In certain embodiments, the first substrate has a first thickness and includes a first antenna, the second substrate has a second thickness greater than the first thickness and includes a second antenna, the second antenna includes a first parasitic strip and a second parasitic strip, the first parasitic strip is disposed on a first side of the second substrate, and the second parasitic strip is disposed on a second side of the second substrate opposite the first side of the second substrate. In some embodiments, the method includes electrically coupling the first antenna to the second antenna and clamping the first substrate to the second substrate.

Various embodiments described herein may improve impedance matching, improve isolation levels, reduce return loss, reduce interference, and/or reduce frequency coupling for antenna modules. Certain embodiments of antenna modules may support multiple frequencies ranging from 600 MHz to 5.2 GHz. For example, in some embodiments, antennas in one antenna module may be configured for 700 MHz, 1.9 GHz, 2.5 GHz, and/or 5.2 GHz transmission and/or reception. In various embodiments, antennas in an antenna module may have a return loss within a range of −15 dB to −20 dB and/or a polarization port isolation within a range of −25 dB to −30 dB (or lower) across all supported frequency bands.

In this regard, FIG. 1 illustrates an exemplary antenna module 100 from a side perspective view. The antenna module 100 includes a substrate 105 having a first circuit board 110 and a second circuit board 115 disposed therein. The first circuit board 110 and the second circuit board 115 are assembled together to form an "X" or "+" shape when viewed from a top view. In some embodiments, the first circuit board 110 is substantially perpendicular to the second circuit board 115. The antenna module 100 also includes a third circuit board 120 and a fourth circuit board 125 assembled together to form an "X" or "+" shape when viewed from a top view. In various embodiments, the third circuit board 120 is substantially perpendicular to the fourth circuit board 125.

The third circuit board 120 is coupled to the first circuit board 110 such that the third circuit board 120 is positioned vertically above and/or coplanar with the first circuit board 110. Furthermore, the fourth circuit board 125 is coupled to the second circuit board 115 such that the fourth circuit board 125 is positioned vertically above and/or coplanar with the second circuit board 115. As used herein, two circuit boards being coupled together may mean that the two circuit boards are connected together with electrical and/or physical connections. Electrical connections may be electrically connected but not necessarily adjacent or physically touching. In other examples, two circuit boards being coupled together may mean that the two circuit boards are a unitary circuit board with two (or more) circuit areas.

By separating the third circuit board 120 from the first circuit board 110, different embodiments of the third circuit board 120 may be coupled to the first circuit board 110 to change the frequency patterns of the antenna module 100 and/or the third circuit board 120 and the first circuit board 110 may be manufactured with different thicknesses to tune the frequency pattern of the antenna module 100. Similarly, by separating the fourth circuit board 125 from the second circuit board 115, different embodiments of the fourth circuit board 125 may be coupled to the second circuit board 115 to change the frequency patterns of the antenna module 100 and/or the fourth circuit board 125 and the second circuit board 115 may be manufactured with different thicknesses to tune the frequency pattern of the antenna module 100.

In some embodiments, the first circuit board 110, the second circuit board 115, the third circuit board 120, and/or the fourth circuit board 125 may be printed circuit boards ("PCBs") or flexible printed circuit boards ("FPCs"). Moreover, in certain embodiments, each of the first circuit board 110, the second circuit board 115, the third circuit board 120, and the fourth circuit board 125 may have an antenna disposed thereon.

The substrate 105 has a first conductive trace 130 and a second conductive trace 135 disposed thereon. The first conductive trace 130 is electrically coupled to the first circuit board 110, and the second conductive trace 135 is electrically coupled to the second circuit board 115. Each of the first conductive trace 130 and the second conductive trace 135 are used for sending signals to the antenna module 100 and/or receiving signals from the antenna module 100. The first conductive trace 130 and the second conductive trace 135 may be formed from any suitable conductive material.

The first circuit board 110 and the second circuit board 115 each have two upside down "L" shaped antenna portions formed thereon. A first "L" shaped antenna portion 140 is shown on the second circuit board 115. The first "L" shaped antenna portion 140 may be formed using any suitable material, such as an electrically conductive material. As used herein, the term "L" shaped may mean having at least two sections oriented generally perpendicular to each other.

A third conductive trace 145 is electrically coupled to the first conductive trace 130 and electrically couples a first antenna disposed on the first circuit board 110 with a second antenna disposed on the third circuit board 120.

The third circuit board 120 and the fourth circuit board 125 each have a pair of parasitic strips formed thereon that form antennas on the third circuit board 120 and the fourth circuit board 125. A first parasitic strip 150 of a first pair of parasitic strips 152 is shown on the third circuit board 120, and a first parasitic strip 155 of a second pair of parasitic strips 158 is shown in the fourth circuit board 125. The parasitic strips 150 and 155 may be formed using any suitable material, such as an electrically conductive material.

Mechanical couplers 160 couple the first circuit board 110 to the third circuit board 120, and the second circuit board 115 to the fourth circuit board 125. Each of the mechanical couplers 160 have a slot 162 that fits over one or more of the first circuit board 110, the second circuit board 115, the third circuit board 120, and the fourth circuit board 125 to fix corresponding circuit boards in place. The mechanical couplers 160 are secured to their respective circuit boards using fasteners 165. A spacer 170 is disposed between the first and second circuit boards 110 and 115 and the third and fourth circuit boards 120 and 125 to facilitate proper alignment of the circuit boards. The mechanical couplers 160, the fasteners 165, and the spacer 170 may be formed from any suitable material, such as a nonconductive plastic. In other examples, the mechanical couplers 160 may be other types of mechanisms for coupling the first circuit board 110 to the third circuit board 120, and the second circuit board 115 to the fourth circuit board 125.

As illustrated, the first circuit board 110, the second circuit board 115, the third circuit board 120, and the fourth circuit board 125 all extend in a vertical direction 175 away from the substrate 105, the second circuit board 115 and the fourth circuit board 125 also extend in a first horizontal direction 180 which is parallel to the substrate 105, and the first circuit board 110 and the third circuit board 120 also extend in a second horizontal direction 185 which is parallel to the substrate 105 and which is perpendicular to the first horizontal direction 180.

FIG. 2 is an exploded view 200 of the antenna module 100 of FIG. 1. The exploded view 200 illustrates a second "L" shaped antenna portion 205 that couples to the second circuit board 115, a third "L" shaped antenna portion 210 that couples to the first circuit board 110, and a fourth "L" shaped antenna portion 215 that couples to the first circuit board 110. The exploded view 200 also illustrates a second parasitic strip 220 of the first pair of parasitic strips 152, and a second parasitic strip 225 of the second pair of parasitic strips 158.

FIG. 3 is a top view 300 of the antenna module 100 of FIG. 1. The top view 300 shows a first connection port 305 used to electrically couple with the first conductive trace 130 and a second connection port 310 used to electrically couple with the second conductive trace 135. The top view 300 also shows the "X" shape formed by the third circuit board 120 and the fourth circuit board 125.

FIG. 4 is a side view 400 of the antenna module 100 of FIG. 1. The side view 400 shows the first "L" shaped antenna portion 140 and the second "L" shaped antenna portion 205 disposed on the second circuit board 115. The side view 400 also shows a first portion 405 and a second portion 410 of the second circuit board 115 that extend through the substrate 105 after the second circuit board 115 is disposed on the substrate 105.

FIG. 5 is a top view 500 of parasitic strips of FIG. 1, according to one embodiment. The first parasitic strip 155 of the second pair of parasitic strips 158 is disposed on a first side of the fourth circuit board 125, and the second parasitic strip 225 of the second pair of parasitic strips 158 is disposed on a second side of the fourth circuit board 125 opposite to the first side. Each of the first parasitic strip 155 and the second parasitic strip 225 has a first length 505 that extends in the first horizontal direction 180. In one example, the first length 505 may be approximately 31.0 mm at a 2.2 GHz center frequency of a frequency band. In another example, the first length 505 may be within the range of 2.0 mm to 35.0 mm, 15.0 mm to 45.0 mm, or 25.0 mm to 65.0 mm.

The first parasitic strip 155 and the second parasitic strip 225 overlap one another in the second horizontal direction 185 over a second length 510. In one example, the second length 510 may be approximately 27.0 mm to achieve a broad frequency band from 1.7 GHz to 2.9 GHz (e.g., approximately 36% from the center frequency) and may have a return loss level better than −10 dB. In another example, second first length 510 may be within the range of 1.0 mm to 30.0 mm, 10.0 mm to 40.0 mm, or 15.0 mm to 50.0 mm. Furthermore, the first parasitic strip 155 and the second parasitic strip 225 do not overlap one another in the second horizontal direction 185 over a third length 515. As may be appreciated, a change in a value of the second length 510 and/or the third length 515 may adjust a frequency corresponding to the second pair of parasitic strips 158 (e.g., antenna frequency). For example, decreasing the second length 510 and/or increasing the third length 515 may increase a frequency corresponding to the second pair of parasitic strips 158. As another example, increasing the second length 510 and/or decreasing the third length 515 may decrease a frequency corresponding to the second pair of parasitic strips 158.

As illustrated in FIG. 5, the first parasitic strip 155 has a first end 520 and a second end 525, and the second parasitic strip 225 has a first end 530 and a second end 535. The first end 520 of the first parasitic strip 155 does not align with the first end 530 of the second parasitic strip 530 in the first horizontal direction 180 (e.g., horizontally misaligned, horizontally offset). As a result of the first end 520 of the first parasitic strip 155 not aligning with the first end 530 of the second parasitic strip 530 in the first horizontal direction 180, a resonance occurs. Furthermore, the second end 525 of the first parasitic strip 155 does not align with the second end 535 of the second parasitic strip 530 in the first horizontal direction 180 (e.g., horizontally misaligned, horizontally offset). As a result of the second end 525 of the first parasitic strip 155 not aligning with the second end 535 of the second parasitic strip 530 in the first horizontal direction 180, a resonance occurs.

FIG. 6 is a side view 600 of the first parasitic strip 155 of FIG. 1. The first parasitic strip 155 has a length 605 in the first horizontal direction 180, and a height 610 in the vertical direction 175. In one example, the length 605 may be approximately 31.0 mm. In another example, the length 605 may be within the range of 2.0 mm to 35.0 mm, 15.0 mm to 45.0 mm, or 25.0 mm to 65.0 mm. In a further example, the height 610 may be approximately 11.0 mm. In another example, the height 610 may be within the range of 1.0 mm to 15.0 mm, 5.0 mm to 20.0 mm, or 10.0 mm to 30.0 mm. In one example, a thickness of the first parasitic strip 155 may be approximately 0.7 mm. In another example, the thickness may be within the range of 0.1 mm to 2.0 mm, 0.5 mm to 3.0 mm, or 1.0 mm to 4.0 mm. As may be appreciated, a change in a value of the length 605 and/or the height 610 may adjust a frequency corresponding to the second pair of parasitic strips 158 (e.g., antenna frequency).

FIG. 7 is a top view 700 of the fourth circuit board 125 of FIG. 1. The fourth circuit board 125 has a width 705 in the second horizontal direction 185. In one example, the width 705 may be approximately 2.0 mm. In another example, the width 705 may be within the range of 0.5 mm to 4.0 mm, 1.0 mm to 5.0 mm, or 2.0 mm to 6.0 mm. It should be noted that a change in the value of the width 705 may adjust a frequency corresponding to the second pair of parasitic strips 158 (e.g., antenna frequency) coupled to the fourth circuit board 125.

FIG. 8 is a top view 800 of the second circuit board 115 of FIG. 1. The second circuit board 115 has a width 805 in the second horizontal direction 185. In one example, the width 805 may be approximately 1.0 mm. In another example, the width 805 may be within the range of 0.1 mm to 2.0 mm, 0.5 mm to 3.0 mm, or 1.0 mm to 4.0 mm. In certain embodiments, the width 805 of the second circuit board 115 is less than the width 705 of the fourth circuit board 125. Furthermore, in various embodiments, a width of the first circuit board 110 is less than a width of the third circuit board 120.

FIG. 9 is a side view 900 of antennas of FIG. 1. The side view 900 shows a first antenna 905 that includes the first "L" shaped antenna portion 140 and the second "L" shaped antenna portion 205, and a second antenna 910 that includes the first parasitic strip 155 and the second parasitic strip 225. The first antenna 905 is designed to transmit at a different frequency than the second antenna 910. The first "L" shaped antenna portion 140 is inverted so that a horizontal bar portion 915 of the first "L" shaped antenna portion 140 extends in the first horizontal direction 180 parallel to the second antenna 910. A vertical bar portion 920 of the first "L" shaped antenna portion 140 extends in the vertical direction 175 perpendicular to the second antenna 910. The second "L" shaped antenna portion 205 is also inverted so that a horizontal bar portion 925 of the second "L" shaped antenna portion 205 extends in the first horizontal direction 180 parallel to the second antenna 910. A vertical bar portion 930 of the second "L" shaped antenna portion 205 extends in the vertical direction 175 perpendicular to the second antenna 910.

As illustrated in FIG. 9, there is a gap 935 between the first antenna 905 and the second antenna 910. In one example, the gap 935 may be approximately 5.0 mm. In another example, the gap 935 may be within the range of 1.0 mm to 4.0 mm, 3.0 mm to 7.0 mm, or 5.0 mm to 20.0 mm. It should be noted that a change in the gap 935 may adjust a polarization purity of a signal transmitted by the first antenna 905 and the second antenna 910.

In certain embodiments, any combination of a change in the second length 510 of an overlapping portion of parasitic strips as described in FIG. 5, the third length 515 of a non-overlapping portion of parasitic strips as described in FIG. 5, the length 605 of a parasitic strip as described in FIG. 6, the height 610 of a parasitic strip as described in FIG. 6, the width 705 of a circuit board having parasitic strips disposed thereon as described in FIG. 7, the width 805 of a circuit board having the first antenna 905 disposed thereon as described in FIGS. 8 and 9, and/or the gap 935 between the first antenna 905 and the second antenna 910 as described in FIG. 9 may be used to adjust features corresponding to the antenna module 100.

FIG. 10 is a top view 1000 of parasitic strips of FIG. 1 and a corresponding frequency graph, according to another embodiment. The first parasitic strip 155 of the second pair of parasitic strips 158 is disposed on a first side of the fourth circuit board 125, and the second parasitic strip 225 of the second pair of parasitic strips 158 is disposed on a second side of the fourth circuit board 125 opposite to the first side. The first parasitic strip 155 and the second parasitic strip 225 overlap one another in the second horizontal direction 185 over a length 1005. A frequency pattern 1010 produced by the first antenna 905 and the second antenna 910 may be directly impacted by the length 1005. For example, a first frequency 1015 may result from the first antenna 905, while a second frequency 1020 may result from the second antenna 910 with an overlap of the length 1005. The resulting frequency pattern 1010 may be a super broadband frequency pattern.

FIG. 11 is a top view 1100 of parasitic strips of FIG. 1 and a corresponding frequency graph, according to yet another embodiment. The first parasitic strip 155 of the second pair of parasitic strips 158 is disposed on a first side of the fourth circuit board 125, and the second parasitic strip 225 of the second pair of parasitic strips 158 is disposed on a second side of the fourth circuit board 125 opposite to the first side. The first parasitic strip 155 and the second parasitic strip 225 overlap one another in the second horizontal direction 185 over a length 1105. A frequency pattern 1110 produced by the first antenna 905 and the second antenna 910 may be directly impacted by the length 1105. For example, a first frequency 1115 may result from the first antenna 905, while a second frequency 1120 may result from the second antenna 910 with an overlap of the length 1105. The resulting frequency pattern 1110 may be a dual band frequency pattern.

FIG. 12 is an illustration 1200 showing return loss and isolation for the antenna module 100 of FIG. 1. A y-axis 1205 represents a decibel measurement and an x-axis 1210 represents a frequency in GHz. A first curve 1215 illustrates one embodiment of a polarization port isolation resulting from the antenna module 100. The polarization port isolation in this embodiment is less than −28 dB and within a range of −28 dB to −35 dB. A second curve 1220 illustrates one embodiment of return loss for a first frequency corresponding to the antenna module 100, while a third curve 1225 illustrates one embodiment of return loss for a second frequency corresponding to the antenna module 100. The return loss in this embodiment ranges from between −10 dB to −25 dB.

FIG. 13 is an illustration 1300 showing isolation for the antenna module 100 of FIG. 1. A y-axis 1305 represents a decibel measurement and an x-axis 1310 represents a frequency in GHz. A first curve 1315 illustrates one embodiment of a polarization port isolation resulting from the antenna module 100. The polarization port isolation in this embodiment is less than −28 dB and within a range of −28 dB to −35 dB.

FIG. 14 is an illustration 1400 showing co and cross polarization frequency patterns for the antenna module 100 of FIG. 1. A y-axis 1405 represents a decibel measurement and an x-axis 1410 represents an angle.

FIG. 15 is a schematic illustrating of a method 1500 for manufacturing the antenna module 100 of FIG. 1. The method 1500 includes (block 1505) vertically aligning a first substrate (e.g., the first circuit board 110) with a second substrate (e.g., the third circuit board 120). In some embodiments, the first substrate has a first thickness and includes a first antenna (e.g., the first antenna 905). In various embodiments, the second substrate has a second thickness greater than the first thickness and includes a second antenna (e.g., the second antenna 910). In certain embodiments, the second antenna includes a first parasitic strip (e.g., the first parasitic strip 155) and a second parasitic strip (e.g., the second parasitic strip 225). In some embodiments, the first parasitic strip is disposed on a first side of the second substrate and the second parasitic strip is disposed on a second side of the second substrate opposite the first side of the second substrate.

The method 1500 also includes (block 1510) electrically coupling the first antenna to the second antenna. The first antenna may be coupled to the second antenna using the third conductive trace 145. The method 1500 additionally includes (block 1515) clamping the first substrate to the second substrate. The first substrate may be clamped to the second substrate using the mechanical couplers 160.

It will be apparent to those skilled in the art having the benefit of the teachings presented in the foregoing descriptions and the associated drawings that modifications, combinations, sub-combinations, and variations can be made without departing from the spirit or scope of this disclosure. Accordingly, the embodiments of the disclosure as set forth above are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

It is noted that the description and claims may use geometric or relational terms, such as right, left, above, below, upper, lower, top, bottom, linear, arcuate, elongated, parallel, perpendicular, horizontal, vertical. These terms are not intended to limit the disclosure and, in general, are used for convenience to facilitate the description based on the embodiments shown in the figures. In addition, the geometric or relational terms may not be exact. For instance, walls may not be exactly perpendicular or parallel to one another but may still be considered to be substantially perpendicular or parallel because of, for example, roughness of surfaces, tolerances allowed in manufacturing, etc.

What is claimed is:

1. An antenna module, comprising:

a first circuit board;

a second circuit board connected to the first circuit board;

a first antenna disposed on the first circuit board; and a second antenna disposed on the second circuit board, wherein the second circuit board comprises a first side and a second side opposite the first side, the second antenna comprises a first parasitic strip and a second parasitic strip, the first parasitic strip is disposed on the first side of the second circuit board, and the second parasitic strip is disposed on the second side of the second circuit board, wherein a first end of the first parasitic strip is horizontally misaligned with a second end of the second parasitic strip.

2. The antenna module of claim 1, wherein misalignment between the first end and the second end results in a resonance corresponding to the second antenna during operation of the second antenna.

3. The antenna module of claim 1, wherein the first antenna is physically separated from the second antenna by a gap.

4. The antenna module of claim 1, wherein:

the first circuit board has a first thickness;

the second circuit board has a second thickness; and the first thickness is less than the second thickness.

5. The antenna module of claim 1, further comprising a plurality of mechanical couplers that connect the first circuit board to the second circuit board.

6. The antenna module of claim 1, wherein the first parasitic strip and the second parasitic strip extend parallel to a horizontal bar portion of an L-shaped portion of the first antenna.

7. The antenna module of claim 1, wherein the first antenna transmits at a first frequency and the second antenna transmits at a second frequency different from the first frequency.

8. The antenna module of claim 1, wherein the first antenna is electrical connected to the second antenna.

9. The antenna module of claim 1, further comprising a third circuit board coupled to the first circuit board such that the third circuit board is perpendicular to the first circuit board, wherein the third circuit board comprises a third antenna.

10. The antenna module of claim 9, further comprising a fourth circuit board coupled to the second circuit board such that the fourth circuit board is perpendicular to the second circuit board, wherein the fourth circuit board comprises a fourth antenna.

11. The antenna module of claim 10, further comprising a first electrical connection that electrically connects the first antenna to the second antenna.

12. The antenna module of claim 11, further comprising a second electrical connection that electrically connects the third antenna to the fourth antenna.

13. The antenna module of claim 12, further comprising a first port electrically coupled to the first electrical connection and a second port electrically coupled to the second electrical connection, wherein the first port is configured to operate the first and second antennas, and the second port is configured to operate the third and fourth antennas.

14. A system, comprising:

a first circuit board;

a second circuit board coupled to the first circuit board such that the second circuit board is perpendicular to the first circuit board;

a third circuit board coupled to the first circuit board such that the third circuit board is co-planar with the first circuit board;

a fourth circuit board coupled to the second circuit board such that the fourth circuit board is perpendicular to the third circuit board and co-planar with the second circuit board;

a first antenna disposed on the first circuit board and a second antenna disposed on the second circuit board, wherein the first antenna and the second antenna each comprises an inverted L-shaped portion; and a third antenna disposed on the third circuit board and a fourth antenna disposed on the fourth circuit board, wherein each of the third antenna and the fourth antenna comprise a first parasitic strip and a second parasitic strip opposite the first parasitic strip.

15. The system of claim 14, wherein the first parasitic strip is horizontally offset relative to the second parasitic strip such that a first end of the first parasitic strip extends past a second end of the second parasitic strip.

16. The system of claim 14, wherein the first antenna is physically separated from the third antenna by a first gap having a first predetermined distance, and the second antenna is physically separated from the fourth antenna by a second gap having a second predetermined distance.

17. The system of claim 14, wherein the first circuit board comprises a first thickness, the third circuit board comprises a second thickness, and the first thickness is less than the second thickness.

18. The system of claim 14, further comprising a plurality of couplers that vertically connect the first and second circuit boards to the third and fourth circuit boards, wherein each coupler of the plurality of couplers comprises a slot within which a corresponding one of the third and fourth circuit boards and a corresponding one of the first and second circuit boards is fixed.

19. A method, comprising:

vertically aligning a first substrate with a second substrate, wherein:

the first substrate has a first thickness and comprises a first antenna;

the second substrate has a second thickness greater than the first thickness and comprises a second antenna;

the second antenna comprises a first parasitic strip and a second parasitic strip;

the first parasitic strip is disposed on a first side of the second substrate; and the second parasitic strip is disposed on a second side of the second substrate opposite the first side of the second substrate;

electrically coupling the first antenna to the second antenna; and clamping the first substrate to the second substrate.

20. An antenna module, comprising:

a first antenna disposed on a first substrate; and a second antenna disposed on a second substrate, wherein the second substrate comprises a first side and a second side opposite the first side, the second antenna comprises a first parasitic strip and a second parasitic strip, the first parasitic strip is disposed on the first side of the second substrate, and the second parasitic strip is disposed on the second side of the second substrate;

wherein:

a return loss corresponding to the antenna module is between −10 dB and −25 dB, and a polarization port isolation corresponding to the antenna module is less than −25 dB;

the first substrate has a first thickness;

the second substrate has a second thickness; and the first thickness is less than the second thickness.

21. The antenna module of claim 20, wherein a first end of the first parasitic strip is horizontally misaligned with a second end of the second parasitic strip.

* * * * *